United States Patent [19]

Jordan

[11] Patent Number: 4,715,522

[45] Date of Patent: Dec. 29, 1987

[54] NAIL RESERVE INDICATOR

[76] Inventor: Rodney B. Jordan, Box 39, Florien, La. 71429

[21] Appl. No.: 938,418

[22] Filed: Dec. 5, 1986

[51] Int. Cl.[4] ..... B25C 7/00

[52] U.S. Cl. ..... 227/156; 227/120

[58] Field of Search ..... 227/120, 126, 127, 128, 227/156

[56] References Cited

U.S. PATENT DOCUMENTS 2,973,519 3/1961 Jopp ..... 227/128

4,386,725 6/1983 Chambers ..... 227/120 X 4,506,819 3/1985 Rand ..... 227/156 X

*Primary Examiner*—Paul A. Bell

[57] ABSTRACT

A device for indicating the depletion of fasteners within the magazine of a pneumatic fastener gun is disclosed. The device comprises an audible signal producing apparatus mounted on the gun housing and a trigger apparatus mounted on the magazine follower. The trigger apparatus activates the signal producing apparatus when it detects a low-fastener condition in the magazine. The signal producing apparatus can be air-powered and can use the fastener gun air chamber as an air source.

9 Claims, 1 Drawing Figure

NAIL RESERVE INDICATOR

Figure 1:
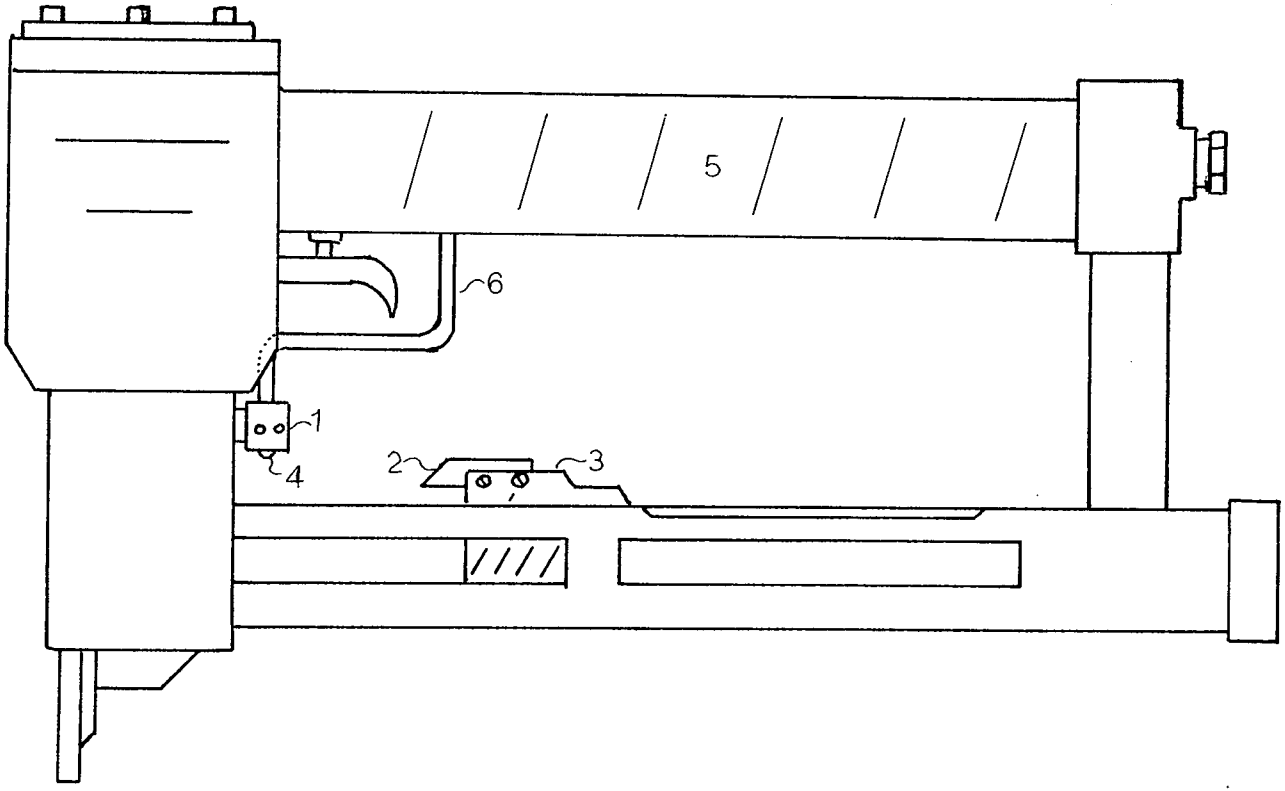

The object of this invention is to provide the operator of a pneumatic nail or staple gun with a warning that he is soon to run out of nails. The device that will provide this warning consists of a low volume air whistle or hiss producing mechanism mounted to the housing of the nail gun in such a way that it will be activated by the magazine follower. As everyone who has operated a nail gun knows, the gun is usually false fired into the work several times when the gun's magazine becomes empty. This not only causes frustration and loss of time, it also often results in damage to the craftman's work. With this device, however the craftsman will be warned of his low nail supply, and thus avoid this problem.

FIG. 1 is a front elevation view of a pneumatic fastener gun equipped with the signaling device.

Referring to FIG. one, it can be seen that the pneumatic signaling device 1 is mounted to the nail gun's housing in such a way that it will be activated by a wedge 2 which is attached to the magazine follower 3. As the plunger approaches the "empty" position, the wedge 2 is forced under the signaling device 1, applying pressure on the valve button 4. This opens the valve in the signaling device, allowing air from the air chamber in the nail gun's handle 5 to flow through the signaling device, creating an audible signal. In the design depicted in FIG. 1, the air passes from the air chamber to the signaling device through the nail gun's trigger guard 6. The wedge in the design depicted in FIG. 1 is affixed to the magazine follower by two screws. Any method of fastening the wedge 2 to the magazine follower 3 would be acceptable, as long as the wedge 2 can be adjusted back and forth. This will allow the craftsman to choose the number of nails that he will have left in the magazine when the alarm sounds. (If the adjusting capability is not desired, the signaling device could be mounted in such a way that it would be activated by the follower itself.) As the nails are used, the wedge 2 will approach the valve button 4. When the specified number of nails is reached, the wedge 2 will begin to apply pressure on the valve button 4, opening the valve and causing the alarm to be activated indicating a low-fastener condition in the magazine. The top of the wedge 2 is flat. This enables the wedge 2 to hold the valve button 4 in the open position as use is continued. The alarm will then continue to sound until the magazine follwer is drawn back for reloading.

What I claim is:

1. A pneumatic fastener driver device with an attached magazine and a device for indicating the depletion of fasteners within the magazine comprising:

(a) a pneumatic fastener driver housing;

(b) a fastener magazine attached to said housing;

(c) means attached to said housing for producing an audible signal; and (d) trigger means attached to said magazine and connected to said signal producing means for detecting a low-fastener condition in said magazine and for triggering said signal producing means so at to produce an audible signal.

2. A device as recited in claim 1, wherein said means for producing an audible signal comprises a pneumatic sound producing device.

3. A device as recited in claim 2, wherein said pneumatic sound producing device comprises a whistle.

4. A device as recited in claim 2, wherein said pneumatic sound producing device comprises:

(a) an air valve;

(b) a means for opening said air valve; and (c) a means for delivering air to said air valve.

5. The device as recited in claim 4 wherein said housing further comprises an air chamber and said means for delivering air to said air valve comprises a tube having an upper end and a lower end, the upper end being connected to said air chamber and the lower end being connected to said air valve.

6. A device as recited in claim 4, wherein said magazine comprises a magazine follower and wherein said signal producing means further comprises a contact means fixed to said magazine follower so as to allow physical contact with said means for opening said air valve.

7. A device as recited in claim 6, wherein said contact means is adjustably fixed to said magazine follower.

8. A device as recited in claim 6, wherein said contact means comprises a wedge whose incline graduates into a level surface.

9. The device as recited in claim 1, wherein said magazine comprises a magazine follower and wherein said magazine follower is part of said trigger means.

* * * * *